US005857511A

United States Patent [19]

Judkins

[11] Patent Number: 5,857,511

[45] Date of Patent: Jan. 12, 1999

[54] DRAPERY WITH HEART-SHAPED HEADERS

[76] Inventor: Ren Judkins, 46 Newgate Rd., Pittsburgh, Pa. 15202

[21] Appl. No.: 627,934

[22] Filed: Mar. 28, 1996

[51] Int. Cl.[6] ..... A47H 13/14

[52] U.S. Cl. ..... 160/348

[58] Field of Search ..... 160/348, 330, 160/84.01, 84.04, 344, 345, 123, 124, 126, 349.1, 349.2

[56] References Cited

U.S. PATENT DOCUMENTS

| | | | |
|---|---|---|---|
| 2,159,733 | 5/1939 | French | 160/348 X |
| 2,227,385 | 12/1940 | Benedict | 160/348 |
| 2,609,873 | 9/1952 | Falkenberg | 160/348 |
| 2,779,405 | 1/1957 | Hess | 160/348 |
| 2,868,286 | 1/1959 | Odermann | 160/348 |
| 3,132,686 | 5/1964 | Judovits | 160/348 |
| 3,286,299 | 11/1966 | Golden | 160/330 X |
| 3,369,589 | 2/1968 | Benkert, Jr. . | |
| 3,730,249 | 5/1973 | Hess | 160/330 X |
| 4,053,009 | 10/1977 | Edlin | 160/348 |
| 4,073,331 | 2/1978 | Zilver | 160/348 |
| 4,582,109 | 4/1986 | Fairbanks | 160/84.04 |
| 4,655,272 | 4/1987 | Reilly et al. | 160/348 |
| 4,747,442 | 5/1988 | Bade | 160/348 |
| 4,915,153 | 4/1990 | Toti . | |
| 5,176,388 | 1/1993 | Horton | 160/348 X |

*Primary Examiner*—David M. Purol
*Attorney, Agent, or Firm*—Buchanan Ingersoll, PPL

[57] ABSTRACT

An apparatus for providing fullness and a shape to the upper end of an elongated section of drapery fabric that selectably allows the drapery to be readily foldable when fullness is not needed. The apparatus may also connect the drapery to an overhead, transverse supporting rail such as through hooks and eyelets or pendants. The apparatus includes a generally heart-shaped header made of a flexible, resilient, relatively stiff material. The header is attachable to a mounting portion of the drapery fabric at an upper end of the drapery fabric. The header is designed to be capable of collapsing into a flat unit when sufficient pressure is applied to the header. The headers can be made to expand evenly when the drape is partially opened. The header is formed generally of a first leg and a second leg that are made of a flexible, resilient material. The first leg and the second leg meet and are connected at the front of the header. Ends of the first leg and the second leg extend toward the rear of the header. A connecting segment then connects the first leg to the second leg at the rear of the header.

17 Claims, 3 Drawing Sheets

DRAPERY WITH HEART-SHAPED HEADERS

BACKGROUND OF THE INVENTION

1. Field of the Invention

This invention relates generally to drapery and more particularly to an apparatus that can provide fullness and a shape to drapery and will also allow the drapery to be easily folded during transportation.

2. Description of the Prior Art

Many homes, apartments and other dwellings use some type of window covering. Draperies, vertical blinds and venetian blinds are examples of well-known window coverings. Draperies are often preferred by consumers over vertical blinds and venetian blinds because they have a softer appearance. Draperies are elongated sections of fabric which are supported at their upper end by a number of eyelets, hooks, pins or other supporting means which are spaced along the top of the drapery fabric. The support means often are connected to carriers that are movable along an overhead track as described below. In this way, the drapery may be moved laterally along the track.

Draperies are available in a variety of materials, but drapery materials are preferred that are more readily foldable as these materials have a more soft appearance and may naturally fold over when the drapery is moved laterally to one side of the window when the drapery is opened. However, such readily foldable materials tend to sag at the plurality of supports along the upper end of the drapery. For this reason and for aesthetic purposes i.e., to provide a more full appearance, draperies require stiffness along their upper end to prevent sagging at the supports.

Heretofore in the industry, stiffness has been provided to the upper end of drapery fabric by permanently affixing sections of materials, such as by sewing, to the upper end of the drapery fabric. Most often a continuous strip of material is sewn to the top of the drape in conjunction with a hem that may or may not wrap around the strip. Another method is to attach permanent extra sections of relatively stiff material between adjacent drapery fabric creases along the upper end of the drapery fabric. The extra sections of material are collectively referred to as "the header" of the drape. In this way, the drapery fabric may still fold along its creases but will maintain an unfolded, bowed, "full" appearance between creases.

The additional thickness imparted by this extra header makes folding, handling and shipping of the drapery fabric difficult. As with any other product, the transportation costs for drapery fabric are increased if each unit of product occupies a greater area during shipping. Thus, for shipping purposes, it would advantageous to be able to fold the drapery fabric into a compact unit and then box the folded drapery fabric. However, the header makes folding of the drapery fabric difficult. When conventional drapery is stacked together, the width of the top of the drapery with the header is several times wider than the width of the middle of the drapery. As a result, it is difficult to box draperies and draperies are usually transported on hangers. Therefore, shipping of conventional drapery over long distance is difficult and is not very cost effective. For this reason, a great amount of drapery is produced or assembled in the local area in which it is sold.

It is clear that there is a desire in the industry to provide a "soft", readily foldable drapery fabric and yet to provide a full, not readily foldable upper end of that fabric. Conventional methods of accommodating these conflicting goals has resulted in the providing of extra sections of material permanently to the upper end of the drapery fabric. This conventional solution has resulted in inefficient transportation of the drapery and difficulty and expense to clean the draperies. For this reason, such drapery is very often manufactured and/or assembled in the local area where it is sold and must be professionally cleaned.

It would be advantageous, therefor, to provide a means for making the upper end of the drapery fabric relatively stiff to provide the drapery fabric with a full appearance and support between carriers and to provide such a means that would selectably allow the drapery fabric to be readily folded, handled or washed when stiffness is not needed or desired. Such means should enable use of existing methods and apparatus for supporting the drapery fabric and for opening or closing the drapery system which typically utilize the upper end of the drapery fabric. Therefore, a discussion of these existing methods and apparatus for supporting the drapery fabric and for opening or closing the drapery system would be useful.

A perspective view of a drapery system of the type currently known in the industry is shown in prior art FIG. 1. The drapery system 10 is comprised of a section of drapery fabric 12 having a series of vertical creases 13 provided thereon. Each of the vertical creases 13 point in the same direction (toward the wall or window being covered by the drapery). The drapery fabric has an upper end 20 which is connected to and supported by an overhead supporting rail 14. A pull cord 16 is attached to a master carrier (not shown) that runs through rail 14 and is used to selectively open and close the drapery.

A preferred means of supporting the drapery fabric and opening or closing the drapery system already known in the art is shown in FIGS. 1 and 2. The overhead supporting rail 14 has two channels 15 and 17 disposed through its length. The slide channel 15 opens along the bottom of the supporting rail 14 substantially along the entire length of the supporting rail 14. A number of carriers 22 are disposed within the rail channel 15 so as to be movably engaged with the rail 14. Each carrier 22 has a generally H-shaped cross section that allows the carrier to slidably fit within the slide channel 15. Being H-shaped, the carrier has a wide slide portion 23 which is disposed within the rail channel 15. A spacer cord 11 runs between adjacent carriers 22.

A series of supporting means, which are typically pendants 18, are connected to the upper end 20 of the drapery fabric 12 and are also connected to the carriers 22. The pendants 18 can be connected to a strip 19 of nylon strap which is attached to the drapery fabric 20 by any convenient means such as by being snapped on, fastened with Velcro™ type fasteners, welded or sewn thereto. Each pendant has a body portion 24 which is affixed to the drapery fabric 12 and also has a head portion 26. The pendant head portion 26 is relatively enlarged and connects to the pendant body portion 24 by means of a relatively narrow neck 27.

The carriers 22 each have a base 30 having a mouth thereupon. The carrier mouth 28 is sized and configured so as to receive the neck 27 of the pendant 18, typically through a snap fit. The pendant head portions 26 prevent the pendant head 26 from moving vertically relative to the carriers 22 when the pendant head 26 is snap fit into the carrier 22. Yet, the pendant is free to rotate about a vertical axis through the neck.

In this way, each of the carriers 22 are connected through the pendant 18 to the drapery fabric upper end 20. The pull cord 16 is connected to the master carrier (not shown) which is connected to at least one of the carriers 22. Thus, the pull cord is able to move the carriers and thus the drapery fabric 12 along the rail 14. When the pull cord is pulled in one direction the master carrier pushes the other carriers closer together and causing the drapery fabric to fold over itself and to be gathered at one end of the rail. The drapery system is then said to be in the open position. When the pull cord is pulled in the opposite direction, master carrier pulls all the carriers until they are spaced fully apart from one another. Now, the drapery system is said to be in the closed position.

In addition to pendants, other supporting means, such as a hook and eyelet arrangement, are also used. The system functions similarly with these other supporting means. For, example, a series of eyelets may be provided along the upper end of the drapery fabric. Then, a number of hooks are provided so that each hook may engage an eyelet and connect to the carrier. Or, a series of hooks can be provided along the upper end of the drapery fabric. Each hook then engages an eyelet upon a carrier. Preferably, the hook or eyelet can rotate about an axis through the hook or eyelet.

SUMMARY OF THE INVENTION

An apparatus is described and shown herein for providing fullness and a shape to the upper end of an elongated section of drapery fabric. The apparatus of the present invention may also selectably allow for the drapery fabric to be readily foldable when fullness is not needed or desired, such as during shipping or cleaning of the drapery fabric. Preferably, the shape-providing apparatus also functions to connect the upper end of the drapery to an overhead, transverse supporting rail of the type currently known in the industry. The drapery fabric is connected to the overhead support rail through any suitable means, such as an arrangement of hooks and eyelets or, as is preferred, through use a plurality of pendants.

The apparatus includes a generally heart-shaped header made of a flexible, resilient, relatively stiff material. The header is attachable to a mounting portion of the drapery fabric at an upper end of the drapery fabric. The mounting portion of the drapery fabric may be integral with and be a part of the drapery fabric or may be a separate mounting member. The header may be permanently attached to the drapery fabric through any convenient means, such as by being sewn or welded thereto or through the use of an adhesive. Alternatively, the header may be removably connected to the drapery fabric through any convenient means, such as through the use of hook and loop type fastening material (known generally as Velcro™) or, as is preferred, through engagement with flaps provided on the drapery mounting portion.

The materials for the header as well as the configuration of the header are chosen so that when the header is attached to the mounting member, the header can be expanded to provide an arcuate contour to the upper end of the drapery fabric. The header is symmetrical and designed to be capable of collapsing into a flat unit when sufficient pressure is applied to the header. The headers can be made to expand evenly when the drape is partially opened.

The header is formed generally of shaping segment and a connecting segment. The shaping segment has a first leg and a second leg that are made of a flexible, resilient material. The first leg and the second leg meet and are connected at the front of the header. Ends of the first leg and the second leg extend toward the rear of the header. A connecting segment then connects the first leg to the second leg at the rear of the header.

The connecting segment is designed to be readily foldable. In fact, the connecting segment preferably has a crease disposed at the mid-point between the first leg and the second leg which facilitates folding of the connecting segment. Thus, when a force is provided laterally to the header, the connecting segment will fold and the first leg and second leg will be moved towards each other collapsing the header into a relatively flat state.

It is preferred that the header include a septum. The septum connects at one end to the first and second leg where the first and second leg meet. The second end of the septum connects to the connecting segment. It is preferred that the septum connects to the connecting segment at the connecting segment hinge. The septum will not interfere at all with the collapsing of the header. Thus, when a lateral force is applied to the header, the first leg and the second leg will both move towards each other and thus towards the septum until they lie in a generally flush contact with the septum. The septum does operate to provide a more full appearance to the header. When the first leg and the second leg have a force acting on them to pull them away from each other, the septum is pulled backward by the connecting segment pulling the portions of the first leg and the second leg where the first and second leg meet toward the rear of the header. This results in the first leg and second leg bowing outward in an arcuate shape. The septum can be made to be more rigid than the legs of the header, but this is not necessary because the septum is in tension.

The header legs are preferably made of a material that is stiff enough to support whatever fabric is chosen for the drapery, so that the drapery fabric does not sag. Acceptable materials for the header legs for use with many of the drapery fabrics typically used in the industry, include crinoline, a fabric that has been stiffened, such as by being starched, material that has been coated or impregnated with plastic, woven materials, and many plastics such as polyester (Mylar™), polyethylene, nylon film, polypropylene, polyvinyl chloride and polycarbonate. Cardboards which are not bulky and which are strong enough to support the drapery fabric when the header is engaged with the mounting member can be used.

The mounting member preferably has a backing portion which is affixed to the upper end of the section of drapery fabric. The mounting member, which preferably is a group of individual segments, further has a plurality of flaps disposed transversely along the mounting member.

The header and the mounting member are configured so that when the header is engaged with the mounting member, the header first leg is disposed between the mounting member backing portion and the mounting member flaps and the second leg is also placed between the mounting member backing portion and the mounting member flaps.

Either the header or the mounting portion, and preferably the header, has attachment means connected thereto. The attachment means may be any suitable means for connecting the drapery fabric apparatus to the overhead supporting rail. The preferred attachment means is a pendant connected to each header. Preferably, the pendant is attached to the center of the header on the septum. Also, the header should be symmetrical about a centerline through the center point where the pendant is connected. The pendants movably engage the support rail directly, or may be connected to carriers which movable engage the support rail. Alternatively, the attachment means may be other connection devices such as a plurality of eyelets sized and configured to engage respective hooks attached to the carriers or a plurality of hooks sized and configured to engage respective eyelets attached to the carriers.

The drapery fabric with which the present preferred apparatus is used is of the type currently known in the industry and described above with reference to FIGS. 1 and 2. Thus, the drapery fabric may have a plurality of preformed, vertically oriented creases transversely spaced thereupon. The creases in the drapery fabric are formed by means well known in the industry, such as by ironing, machine pleating, stitching or welding the drapery fabric. It is preferred that headers of the present invention each be provided between a pair of adjacent drapery creases. The headers may be connected directly to the drapery fabric or through a separate mounting member.

The mounting portion and the insert member are configured so that the mounting portion may be selectably received by and connected to the header. When the mounting portion is integral with and a part of the drapery fabric, the mounting portion is preferably made of a number of flaps. The flaps extend downward from the upper end of the drapery fabric. The separate mounting member is preferably made of a backing portion which is attachable to the drapery and a plurality of flaps. The flaps each connect to the backing portion along an upper end of the backing portion.

The mounting portion is made of any material that will readily fold, is not bulky and which is strong enough to support the drapery fabric when the header is engaged with the mounting member. The mounting member is preferably made of the same material as the header. This material may be crinoline, a fabric that has been stiffened, such as by being starched, material that has been coated or impregnated with plastic, woven materials, and many plastics such as polyester (Mylar™), polyethylene, nylon film, polypropylene, polyvinyl chloride and polycarbonate.

Preferably, a single pendant is connected to each header. Each pendant is then movably connected to the overhead supporting rail, either directly or through connection with a carrier. The weight of the drapery causes the mounting portion to move downward relative to the header. At the same time, the header, to which the pendants are attached, is fixed in position. As the mounting portion moves downward, the transverse creases of the mounting member will sit upon the upper edge of the header. The header is thus held in position thereby.

Other objects and advantages of the invention will become apparent from a description of certain present preferred embodiments thereof shown in the drawings.

DETAILED DESCRIPTION OF THE PREFERRED EMBODIMENTS

Figure 3:
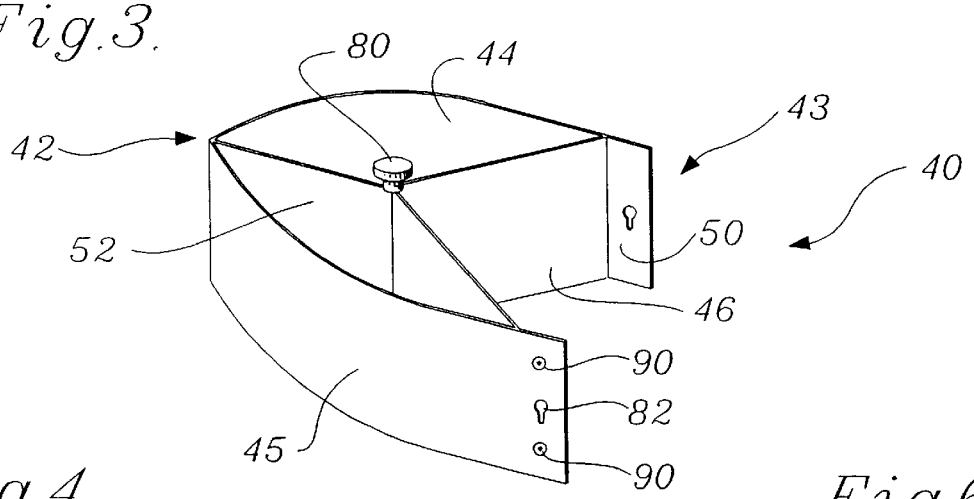
FIG. 3 is a perspective view of a portion of a first preferred embodiment of the heart-shaped header.
Figure 4:
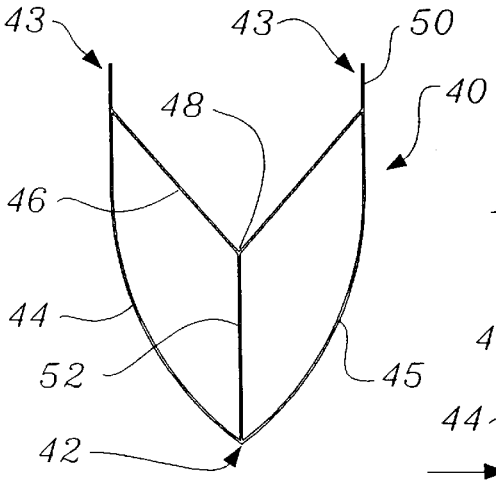
FIG. 4 is a top plan view of the first preferred embodiment of the heart-shaped header in an expanded position.

Referring first to FIGS. 3 and 4, a header 40 is shown which has a front 42 and a rear 43. The header 40 is formed generally of a first leg 44 and a second leg 45 that are made of a flexible, resilient material. The first leg 44 and the second leg 45 meet and are connected at the front 42 of the header 40. Both the first leg 44 and the second leg 45 extend toward the rear 43 of the header 40. A connecting segment 46 then connects the first leg 44 to the second leg 45 at the rear 43 of the header 40.

The connecting segment 46 is designed to be readily foldable. In fact, the connecting segment 46 preferably has a hinge or crease 48 disposed at the mid-point between the first leg 44 and the second leg 45 which facilitates folding of the connecting segment 46. Thus, when a force is provided laterally to the header 40, the connecting segment 46 will fold about the crease 48 and the first leg 44 and second leg 45 will be moved towards each other, collapsing the header 40 into a relatively flat state.

It is preferred that the header 40 include a septum 52. The septum 52 connects at one end to the first leg 44 and second leg 45 where the first and second leg 44, 45 meet. The second end of the septum 52 connects to the connecting segment 46. It is preferred that the septum 52 connects to the connecting segment 46 at the connecting segment hinge 48.

The septum 52 will not interfere at all with the collapsing of the header 40. Thus, when a lateral force is applied to the header 40, the first leg 44 and the second leg 45 will both move towards each other and thus towards the septum 52 until they lie in a generally flush contact with the septum 52.

The septum 52 operates to provide a more full appearance to the header 40. When the first leg 44 and the second leg 45 have a lateral force acting on them to pull them away from each other, the septum 52 is pulled downward by the connecting segment 46, pulling the first leg 44 and the second leg 45 at the front 42 of the header 40 toward the rear 43 of the header 40. This results in the first leg 44 and the second leg 45 bowing outward in an arcuate shape.

Figure 5:
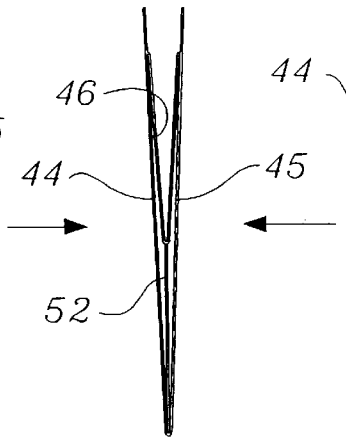
FIG. 5 is a top plan view of the first preferred embodiment of the heart-shaped header in a collapsed position.

Referring next to FIGS. 4 and 5, the collapsibility of the present header 40 will be discussed. The legs 44, 45 of the header 40 are made of a resilient material. Therefore, when no external forces are acting on the header 40, as shown in FIG. 4, the first leg 44 and the second leg 45 will tend to move away from one another. As the first leg 44 and the second leg 45 move away from one another, the connecting member 46 will tend to straighten out. The septum 52 which is connected to the connecting member 46 will thus be moved by the connecting member 46 towards the rear 43 of the header 40. Thus, the end of the septum 52 which connects to the first leg 44 and the second leg 45 at the front 42 of the header 40 will also be pulled toward the rear 43 of the header 40. This pulling of the septum 52 toward the rear 43 of the header 40 will cause the first leg 44 and the second leg 45 to bow outward, presenting an arcuate profile (seen best in FIG. 4).

When a compressive force is applied laterally to the header (as shown by the arrows in FIG. 5), the first leg 44 and the second leg 45 will be moved towards one another and the connecting member 46 will fold over. As a sufficient compressive force is applied to the header 40, the first leg 44, the second leg 45, the connecting member 46 and the septum member 52 will lie virtually flush with one another (as shown in FIG. 5). When the compressive force is removed from the header, the resilience of the material comprising the first leg 44 and the second 45 will again cause the header to expand out into the position shown in FIG. 4.

Figure 6:
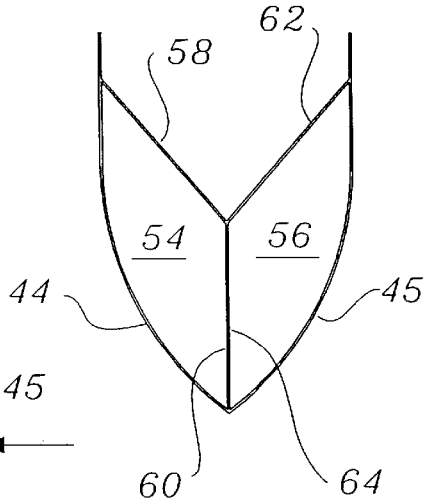
FIG. 6 is a top plan view of the first preferred embodiment of the heart-shaped header showing its preferred manner of fabrication.

The preferred manner of fabricating the header 40 is shown in FIG. 6. Preferably, the header 40 is formed from two cells, a first cell 54 connected to a second cell 56. First cell 54 is formed from the first leg 44 connected to a septum portion 60 and a connecting member portion 58. Similarly, the second cell 56 is formed from the second leg 45 connected to a septum portion 64 and a connecting member portion 62. The two cells 54, 56 are then affixed together along the septum portions 60, 64. Thus, the septum 52 is preferably formed from two overlapping sections of material providing increased rigidly and strength to the septum 52.

Figure 1:
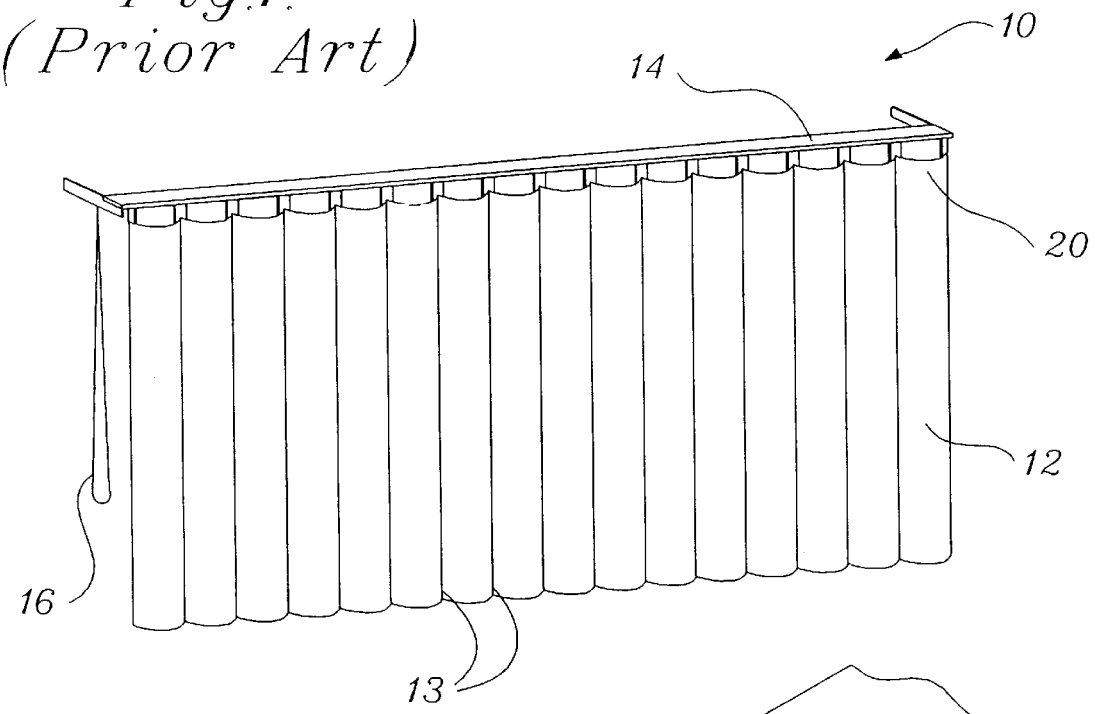
Fig.1. (Prior Art)
FIG. 1 is a perspective view of a prior art drapery system.
Figure 2:
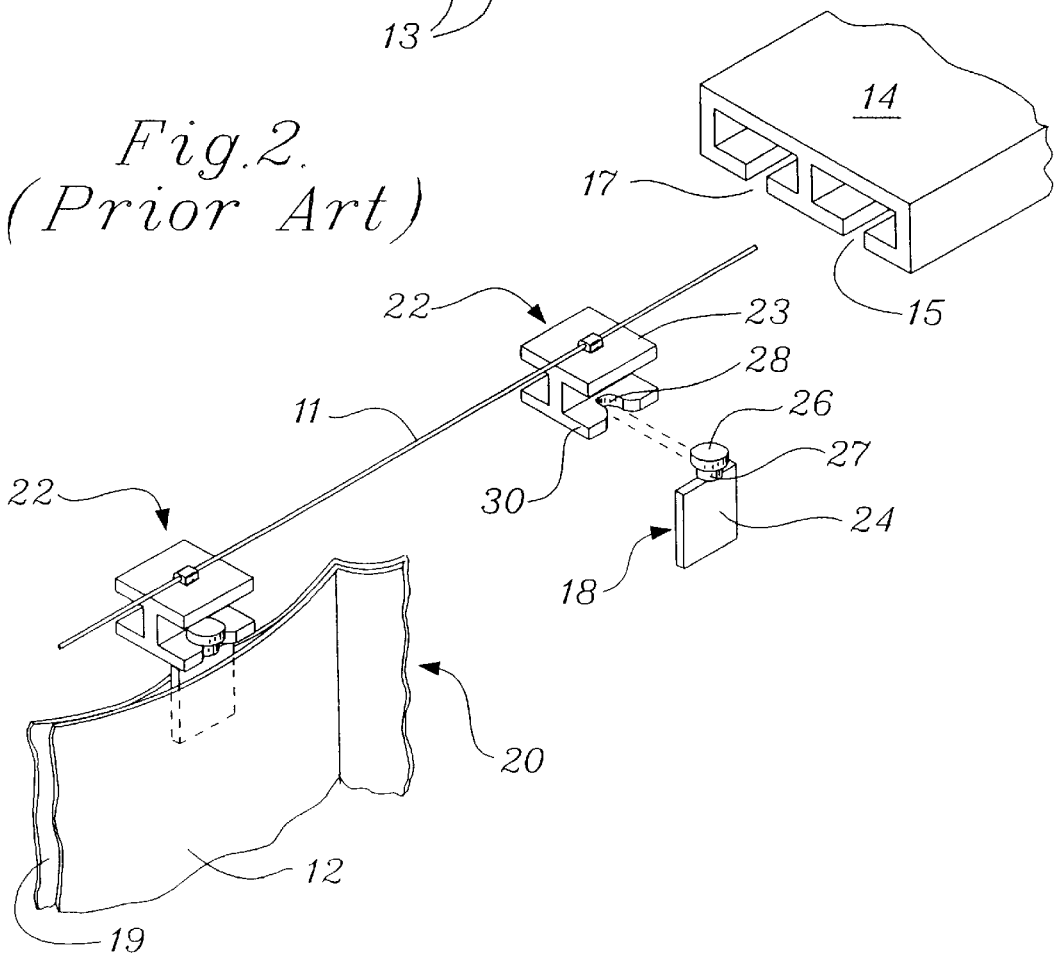
Fig.2. (Prior Art)
FIG. 2 is a perspective view showing a prior art means for mounting and for opening and closing the drapery fabric.
Figure 7:
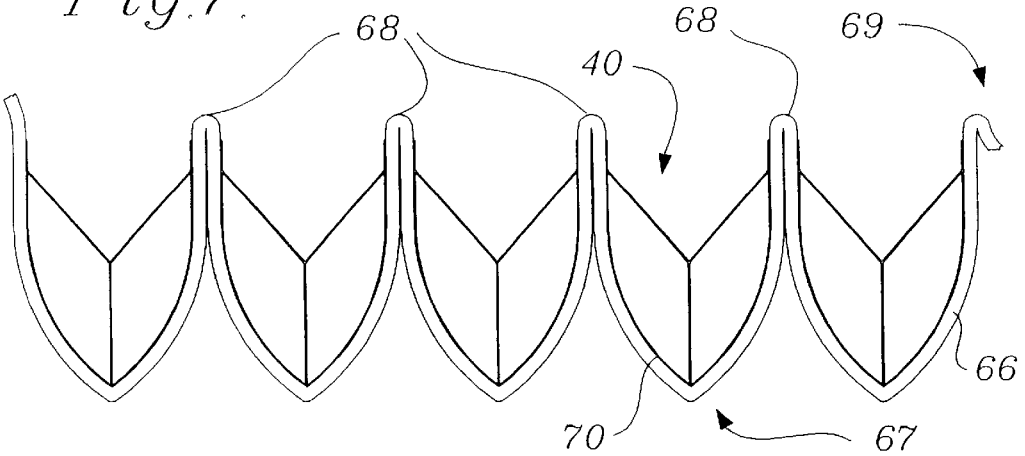
FIG. 7 is a top plan view of a number of the present preferred heart-shaped headers in engagement with a section of drapery fabric.

The use of the present invention in a drapery system is depicted in FIG. 7. In FIG. 7 a plurality of headers 40 are connected to a section of drapery 66. The drapery 66 with which the present invention is used is of the type currently known in the industry and described above with reference to FIGS. 1 and 2. In particular, the drapery 66 has a plurality of preformed, vertically oriented creases 68 transversely spaced thereupon. The creases 68 in the drapery 66 are formed by means well known in the industry, such as by stitching, adhesives or welding the drapery fabric 66. Each header 40 is disposed between a pair of adjacent drapery creases 68. Thus, each header 40 will provide a full shape to the drapery 66 between drapery creases 68. Whether the drapery 66 is fully extended or is gathered up close, the resilience of the headers 40 will allow the headers 40 to collapse or expand to accommodate the degree to which the draperies are drawn. The drapery 66 has a front 67 and a rear 69 such at each of the creases 68 are all directed in the same direction toward the rear 69 of the drapery 66. The headers 40 are connected to the drapery 66 such that the front end 42 of each header 40 is directed toward the front 67 of the drapery 66. Similarly, the rear 43 of each header 40 is directed toward the rear 69 of the drapery 66.

Figure 8:
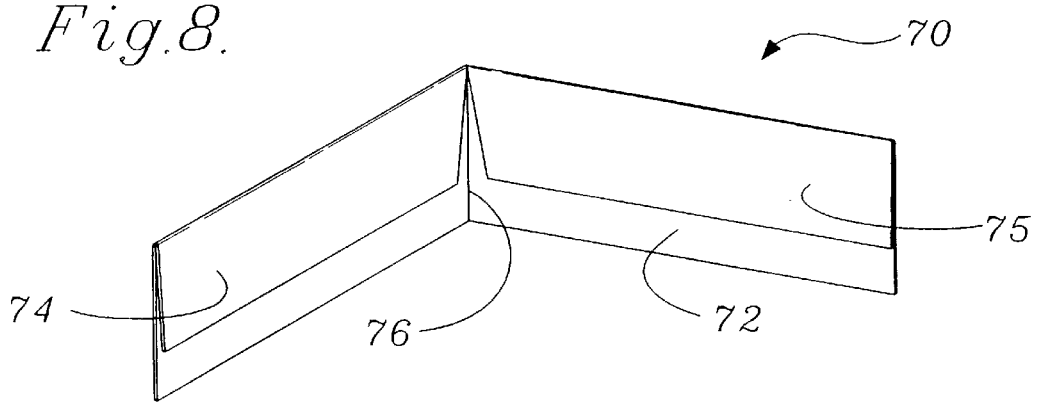
FIG. 8 is a perspective view of the preferred mounting member of the present invention.

The headers 40 are connected to the drapery 66 by any convenient means. The headers 40 may be attached directly to the drapery 66 such as by being welded, sewn or affixed by an adhesive thereto. It is preferred that the headers 40 are connected to the drapery 66 through the use of a mounting portion 70. As noted, the mounting portion 70 may be comprised of the drapery fabric itself. Preferably, mounting portion 70 is a separate member, as shown in FIG. 8. A mounting member 70 preferably has a backing portion 72 which is affixed to the section of drapery fabric 66. The backing portion 72 of the mounting member 70 may be detachably connected to the drapery such as through the use of corresponding sections of hook and loop type fastening material (known generally as Velcro™). Also, the backing portion 72 of the mounting member 70 may be permanently affixed to the drapery, such as by being integral with and a part of the drapery or be being a separate piece that is sewn, molded or attached by an adhesive to the drapery. The mounting portion 70 further preferably has a set of flaps 74, 75 disposed transversely along the mounting member 70. It is further preferred that the mounting portion 70 have a hinge or crease 76 disposed thereon. Thus, the mounting portion 70 preferably has a flap 74, 75 provided on each side of the crease 76.

Figure 9:
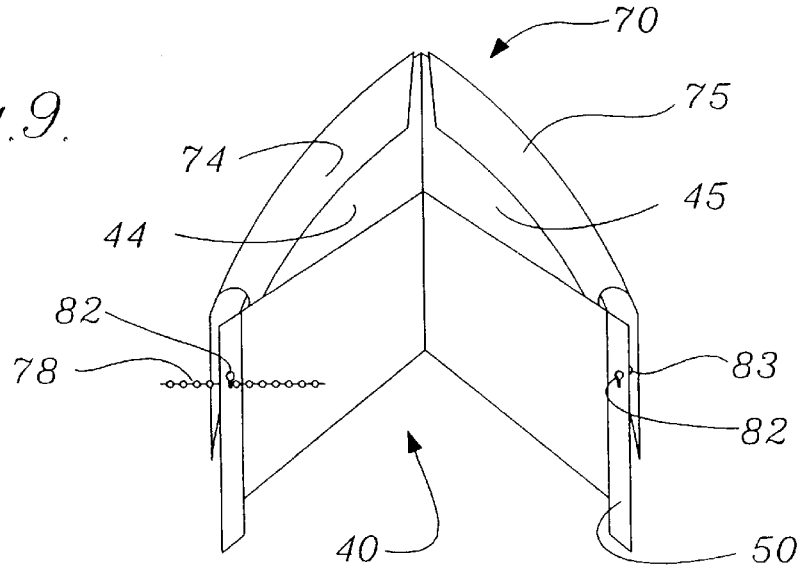
FIG. 9 is a perspective view of the present preferred heart-shaped header in engagement with the preferred mounting member.

Referring next to FIGS. 3, 8 and 9, the preferred header 40 is shown in FIG. 9 engaged with the preferred mounting member 70. The front 42 of the header 40 is placed into the crease 76 of the mounting portion 70. Then, one flap 74 is provided over top of the first leg 44 while the other flap 75 is provided over the second leg 45. A spacer 78 (a portion of which is shown in FIG. 9) may be disposed through aperture 82 in the header 40 and may also be disposed through an aperture 83 in the mounting member 78.

As described above, an attachment means 80 such as a pendant is preferably connected to the header 40 (shown in FIG. 3). Preferably the attachment means 80 is connected to the header 40 where the septum 52 and the connecting member 46 meet. However, the attachment means 80 may be provided anywhere along the header 40, such as to the connecting member 46, the septum 52, the legs 44, 45 or the tabs 50 of the legs 44, 45. The attachment means is then connected to the overhead supporting rail (not shown in FIG. 9) of the type known in the industry (and described and shown with respect to FIGS. 1 and 2 above). When the attachment means 80 are thus connected to this supporting rail, the weight of the drapery fabric 66 will pull the mounting member 70 downwards so that the header 40 will be snugly wedged into the transverse creases formed by the underside of the flaps 74, 75 of the mounting portion 70. In this way, the headers 40 will support the mounting member 70 and thus the drapery fabric, preventing the drapery fabric from moving downward.

Figure 10:
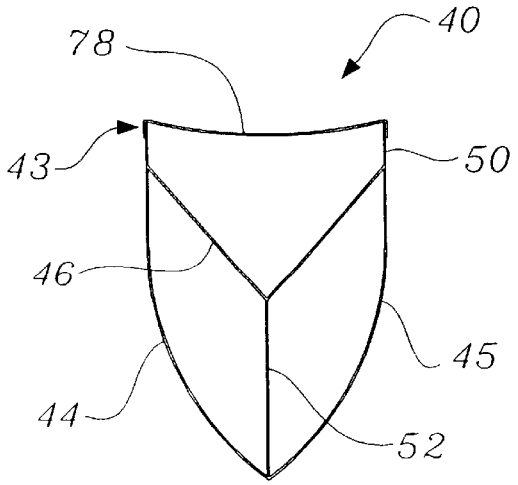
FIG. 10 is a top plan view of a second preferred embodiment of a heart-shaped header.

As described above with reference to FIGS. 4 and 5, when the first leg 44 and second leg 45 move away from one another laterally, the septum 52 pulls the front of the header 42 towards the rear of the header 43. If the first leg 44 and the second leg 45 are moved too far laterally away from one another, such as when the drapery fabric is fully extended, the shape of the header could be distorted. Thus, it is preferred that means be provided on the header to prevent the first leg 44 and the second leg 45 from moving too far laterally away from one another. As can be seen in FIG. 10, it is preferred that a spacer 78 be used for this purpose. The spacer 78 may connect the first leg 44 to the second leg 45 along the rear 43 of the header 40. The spacer 78 may be a chain, a cord or a ribbon or any other material that will readily fold when it is desired to fully collapse the header 40.

The spacer 78 may also be disposed through apertures 82 disposed through the legs 44, 45 of the header 40 (preferably through tabs 50), as shown in FIG. 3. The spacer 78 would then connect to each leg 44, 45. The apertures 82 are preferably of the keyhole variety. Thus, a chain may be used as the spacer 78 and the position of the chain may be maintained by disposing the chain through the aperture 82 and then sliding the chain downward into the narrow portion of the aperture 82. The spacer 78 may also pass through the mounting member 70.

Adjacent headers 40 may be connected at adjacent legs. Thus, each leg 44, 45 may have connection means, such as snaps 90 provided thereon, preferably at the tabs 50.

The header legs 44, 45 are preferably made of a material that is stiff enough to support whatever fabric is chosen for the drapery 66, so that the drapery fabric 66 does not sag. Acceptable materials for the header legs 44, 45 for use with many of the drapery fabrics typically used in the industry, include crinoline, a fabric that has been stiffened, such as by being starched, material that has been coated or impregnated with plastic, woven materials, and many plastics such as polyester (Mylar™), polyethylene, nylon film, polypropylene, polyvinyl chloride and polycarbonate. Cardboards which are not bulky and which are strong enough to support the drapery fabric 66 when the header 40 is engaged with the mounting member 70 can be used.

Variations of the preferred embodiments could be made. For, example, the header and the mounting portion (either the drapery itself or a separate member) could be held in engagement with one another by any convenient means such as through corresponding sections of hook and loop type fastening material (known generally as Velcro™).

As noted, the mounting portion 70 may also be the drapery 66 itself. In this case, the backing portion 72 of the mounting portion 70 will be the drapery 66 itself and the flaps 74, 75 will extend downward directly from the drapery 66 either as part of the drapery material or as separately attached members. Each flap 74, 75 may be coated or impregnated with plastic to increase its rigidity where drapery fabric is used.

Figure 11:
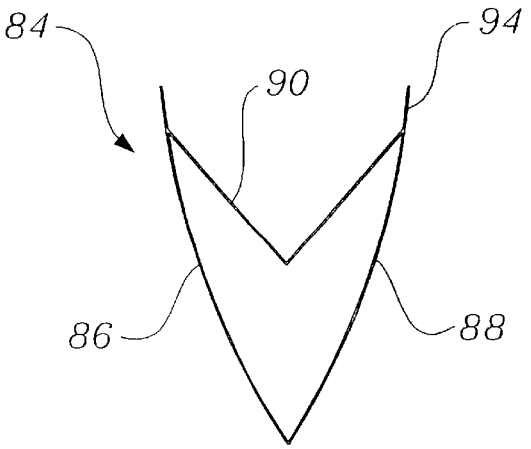
FIG. 11 is a top plan view of another preferred embodiment of a heart-shaped header.

Referring next to FIG. 11, an alternative embodiment of a header 84 is shown. In this embodiment, the header 84 is virtually the same as that described above with reference to the first preferred embodiment (40) except that no septum is used in this embodiment. The resilient material of the legs 86, 88 will still urge the legs 86, 88 outward away from one another and the connecting member 90 will still allow the header 84 to readily collapse. However, with no septum, nothing will urge the front of the header 84 rearward. Thus, the legs 86, 80 will not be caused to bow and will therefore present a more angular and less arcuate profile at the front of the header 84. This embodiment may also have tabs 94 and may have a spacer (not shown in FIG. 11) or one or more pendants (not shown in FIG. 11) attached thereto. In fact, the embodiment shown in FIG. 11 may operate in substantially the same manner as the embodiments shown and described above. The embodiment of FIG. 11 would require a material having a large resilience.

While certain present preferred embodiments have been shown and described, it is distinctly understood that the invention is not limited thereto but may be otherwise embodied within the scope of the following claims.

I claim:

1. A collapsible header for providing a shape to an upper end of an elongated drapery, the header having a front and a rear, the header comprising:

a first leg and a second leg made of a flexible, resilient material, wherein the first leg and second leg meet and are connected at the front of the header;

a foldable connecting segment connected between the first leg and the second leg towards the rear of the header; and an elongated septum that is connected at a first end to at least one of the first leg and to the second leg and is connected at a second end to the connecting segment.

2. The header of claim 1 wherein the connecting segment has a hinge thereon so as to be readily foldable and wherein the septum connects to the connecting segment at the hinge.

3. The header of claim 1 wherein the header is sized and shaped to be engageable to the elongated drapery by means of a mounting portion on the drapery.

4. The collapsible header of claim 1 also comprising a pendant attached to the septum.

5. The collapsible header of claim 1 wherein the pendant is removably attached to the header.

6. A collapsible header for providing a shape to an upper end of an elongated drapery, the header having a front and a rear, the header comprising:

a first leg and a second leg made of a flexible, resilient material, wherein the first leg and second leg meet and are connected at the front of the header;

a foldable connecting segment connected between the first leg and the second leg towards the rear of the header; and a pendant attached to the header at a center of gravity of the header.

7. The collapsible header of claim 6 wherein the pendant is removably attached to the header.

8. A collapsible header for providing a shape to an upper end of an elongated drapery, the header having a front and a rear, the header comprising:

a first leg and a second leg made of a flexible, resilient material, wherein the first leg and second leg meet and are connected at the front of the header;

a foldable connecting segment connected between the first leg and the second leg towards the rear of the header; and at least one connector on the header sized and positioned for attaching the header to an adjacent header housing a mating connector.

9. The header of claim 8 wherein the legs each have a tab and the at least one connector is attached to a tab.

10. A collapsible header for providing a shape to an upper end of an elongated drapery, the header having a front and a rear, the header comprising:

a first leg and a second leg made of a flexible, resilient material, wherein the first leg and second leg meet and are connected at the front of the header;

a foldable connecting segment affixed to each of the first leg and the second leg towards the rear of the header; and wherein the legs of the header each have at least one hole sized and positioned to permit one of a cord and a chain to pass through each hole.

11. The header of claim 10 wherein the legs each have a tab and the at least one hole is in the tab.

12. A collapsible header in combination with an elongated drapery, said elongated drapery having a mounting portion, wherein said header is sized and shaped to be engageable to said elongated drapery by means of said drapery mounting portion wherein the header provides a shape to an upper end of the elongated drapery, said header having a front and a rear and comprised of:

a first leg and a second leg made of a flexible, resilient material, wherein the first leg and the second leg meet and are connected at the front end of the header; and a foldable connecting segment connected between the first leg and the second leg towards the rear of the header.

13. The header of claim 12 wherein the mounting portion is integral with and is formed from the elongated drapery.

14. The header of claim 12 wherein the mounting portion includes a plurality of flaps transversely spaced along the mounting portion.

15. The header of claim 12 wherein the mounting portion is a separate mounting segment that is removably attached to the elongated drapery.

16. The header of claim 12 wherein the mounting segment is comprised of a backing portion that is removably attached to the drapery and a plurality of flaps which are transversely spaced along the mounting member.

17. The header of claim 12 further comprising an elongated septum that is connected at a first end to the first leg and to the second leg at the front of the header and is connected at a second end to the connecting segment.

* * * * *